US010161184B2

(12) United States Patent
Lampe

(10) Patent No.: US 10,161,184 B2
(45) Date of Patent: Dec. 25, 2018

(54) TELESCOPIC LADDER ASSEMBLY

(71) Applicant: Lampe Holding B.V., Bennebroek (NL)

(72) Inventor: Caspar Bernard Lampe, Luchthaven Schiphol (NL)

(73) Assignee: Lampe Holding B.V., Bennebroek (NL)

( * ) Notice: Subject to any disclaimer, the term of this patent is extended or adjusted under 35 U.S.C. 154(b) by 0 days.

(21) Appl. No.: 15/502,251

(22) PCT Filed: Aug. 17, 2015

(86) PCT No.: PCT/NL2015/050579

§ 371 (c)(1),
(2) Date: Feb. 7, 2017

(87) PCT Pub. No.: WO2016/028147

PCT Pub. Date: Feb. 25, 2016

(65) Prior Publication Data

US 2017/0226801 A1 Aug. 10, 2017

(30) Foreign Application Priority Data

Aug. 18, 2014 (NL) ..... 2013338
Aug. 18, 2014 (NL) ..... 2013339

(51) Int. Cl.
*E06C 1/18* (2006.01)
*E06C 1/12* (2006.01)
*E04G 5/10* (2006.01)

(52) U.S. Cl.
CPC ..... *E06C 1/125* (2013.01); *E04G 5/10* (2013.01); *E06C 1/18* (2013.01)

(58) Field of Classification Search
CPC ..... E06C 1/125
See application file for complete search history.

(56) References Cited

U.S. PATENT DOCUMENTS 1,712,942 A 5/1929 Smith
2,194,856 A 3/1940 Kostuk
(Continued)

FOREIGN PATENT DOCUMENTS

CN 201273132 Y 7/2009
CN 101918671 A 12/2010
(Continued)

*Primary Examiner* — Alvin C Chin-Shue
(74) *Attorney, Agent, or Firm* — Hoffmann & Baron, LLP

(57) ABSTRACT

A telescopically extendable and collapsible ladder assembly includes a top ladder section, a bottom ladder section, and one or more intermediate ladder sections. The assembly may include sliding automatic release actuators, having a slanted actuating surface for interaction with actuator surfaces of spacers provided at each end of a rung of an adjacent ladder section, such that, when a rung is moved towards the rung of an adjacent lower ladder section, the activation surfaces of the spacers push the release actuators into an unlocking position and subsequently position the rung at an anti-finger pinching distance. The top rung of the bottom ladder section may be provided with a centrally arranged grip element that forms a housing for manually operable release actuators provided at the bottom side of the rung.

19 Claims, 8 Drawing Sheets

(56) References Cited

U.S. PATENT DOCUMENTS

| | | | | |
|---|---|---|---|---|
| 3,671,065 | A * | 6/1972 | Bingham | E05C 1/10 292/175 |
| 5,495,915 | A * | 3/1996 | Weston | E06C 1/125 182/195 |
| 5,738,186 | A | 4/1998 | Jones | |
| 5,743,355 | A | 4/1998 | McDonnell et al. | |
| 6,912,880 | B2 * | 7/2005 | Ling | E05B 37/0034 70/284 |
| 2006/0226659 | A1 * | 10/2006 | Kraus | E05B 1/0046 292/2 |
| 2006/0283665 | A1 * | 12/2006 | Yao | E06C 1/125 182/195 |
| 2007/0209875 | A1 | 9/2007 | Chen | |
| 2009/0050407 | A1 * | 2/2009 | Eriksson | E06C 1/125 182/195 |
| 2010/0071996 | A1 * | 3/2010 | Huang | E04G 1/34 182/118 |
| 2012/0193167 | A1 * | 8/2012 | Winter, IV | E06C 1/125 182/78 |

FOREIGN PATENT DOCUMENTS

| | | | | |
|---|---|---|---|---|
| CN | 102140872 | A | 8/2011 | |
| CN | 202194553 | U | 4/2012 | |
| CN | 202348099 | U | 7/2012 | |
| DE | 202012100131 | U1 | 5/2012 | |
| DE | 202012104992 | U1 | 3/2013 | |
| EP | 0527766 | B1 | 6/1996 | |
| EP | 1402143 | B2 | 8/2008 | |
| EP | 2634360 | A1 | 9/2013 | |
| GB | 2263932 | A | 8/1993 | |
| WO | 91/15651 | A1 | 10/1991 | |
| WO | WO 9523907 | A1 * | 9/1995 | E06C 1/125 |
| WO | 2004/013445 | A1 | 2/2004 | |
| WO | 2009/057995 | A1 | 5/2009 | |

* cited by examiner

TELESCOPIC LADDER ASSEMBLY

CROSS-REFERENCE TO RELATED APPLICATIONS:

This application is the National Stage of International Application No. PCT/NL2015/050579, filed Aug. 17, 2015, which claims the benefit of Netherlands Application Nos. NL 2013338, filed Aug. 18, 2014, and NL 2013339, filed Aug. 18, 2014, the contents of all of which are incorporated by reference herein.

FIELD OF THE INVENTION

The present invention relates to a telescopically extendable and collapsible ladder assembly having at least three ladder sections.

These ladder assemblies have become quite popular as portable ladders, such as a straight telescopic ladder or a step ladder, but also for stationary mounting, such as a loft ladder providing access to a loft.

BACKGROUND OF THE INVENTION

Prior art designs of such ladder assemblies have already been disclosed as early as 1929 in the U.S. Pat. No. 1,712,942 (Smith). More recent designs are disclosed in EP 527 766, EP 1 402 143, GB 2263932 (Telesteps), WO2004/013445 (Core Distribution), U.S. Pat. No. 5,743,355 (McDonnell), U.S. Pat. No. 5,738,186 (Foxdale), CN 201 273 132 (Zhengjiang Hu), CN 202 194 553 (Xiaoqiu Shen), U.S. Pat. No. 5,738,186 (Jones), DE 20 2012 104992 (Xhen Xiaoling) and DE 20 2012 100131 (Ying Fengruo).

The prior art designs have details that are not satisfactory, either with regard to their construction and/or their practical use. Therefore the present invention aims to propose measures that allow for improvements. These measures can either be applied alone or in combination.

SUMMARY OF THE INVENTION

According to a first aspect, the present invention relates to a telescopically extendable and collapsible ladder assembly having a top ladder section, a bottom ladder section, and one or more intermediate ladder sections.

The top ladder section and each of the one or more intermediate ladder sections have two tubular stile members arranged parallel to each other and interconnected at a top end by a ladder rung to form a U-shaped ladder section. The bottom ladder section has two tubular stile members arranged parallel to each other and interconnected by a top ladder rung and a bottom ladder rung.

The ladder rungs are made from an aluminium tubular profile, for example an extruded aluminium profile, the profile including a top wall, a bottom wall, as well as a front and a back wall extending between the top wall and the bottom wall.

Each ladder section includes a connector at each end of a rung, each connector having a rung portion connected to the end of the rung and a stile member portion connected to one of the stile members of the ladder section.

The stile members of the top ladder section and of the one or more intermediate ladder sections are telescopically inserted into the stile members of an adjacent lower ladder section, so that the one or more intermediate ladder sections and the top ladder section can be collapsed in a collapsing direction towards the bottom ladder section.

The top rung of the bottom ladder section and the rung of each of the one or more intermediate ladder sections are provided at each end with a spacer for, when the ladder assembly is in a collapsed condition, supporting the adjacent upper ladder rung at a predetermined anti-finger pinching distance from the ladder rung on which the spacer has been provided. This, to prevent fingers from getting pinched between the ladder rungs when the ladder assembly is brought into its collapsed position. In an embodiment, this anti-finger pinching distance is for example 2 cm measured between the top wall of a ladder rung and the bottom wall of an adjacent upper ladder rung.

The top rung of the bottom ladder section and the rung of each of the one or more intermediate ladder sections are provided at each end with an automatic latch mechanism, the automatic latch mechanisms being adapted for automatically locking the stile members of the adjacent higher ladder section in a fully extended position of said adjacent higher ladder section. Typically, such a latching mechanism comprises a locking pin biased by a spring element into a locking position, in which locking position the pin is inserted into overlapping openings in the style members. It is observed that latching mechanisms are generally known in the prior art, and are therefore not elaborated upon herein.

The automatic latch mechanisms of the intermediate ladder sections each comprise a locking pin, which locking pins are each moveably supported for movement along a rung in a longitudinal direction thereof, between a locking positon, in which an end of the locking pin is inserted in an opening provided in the stile member of the adjacent upper ladder section to lock the stile members relative to each other, and an unlocking position, in which said end of said locking pin is retracted from said opening, and wherein each locking pin is biased towards the stile member, i.e. towards the locking position.

The automatic latch mechanisms of the intermediate ladder sections each comprise an automatic release actuator, which automatic release actuators are coupled with the locking pin of the automatic latch mechanisms, for unlocking the stile member of an adjacent higher ladder section by moving the automatic release actuator from its passive positon into its actuated position, and thus moving the locking pin from its locking position into its unlocking position, in order to allow for collapsing of the ladder assembly.

The automatic latch mechanisms of the bottom ladder section each comprise a manually operable release actuator, which manually operable release actuators are coupled with the locking pin of the automatic latch mechanisms, for unlocking the stile member of an adjacent higher ladder section by moving the locking pin into its unlocking position, in order to allow for collapsing of the ladder assembly.

The use of spacers if for example shown in patent publication US20070209875, which discloses a collapsible ladder assembly of which the ladder rungs are at their opposite ends provided with spacers to keep the ladder rungs at a predetermined anti-finger pinching distance when the ladder assembly is in its collapsed position. The automatic latching mechanisms provided at the opposite ends of the ladder rungs are manually operated by way of push buttons located in the front wall of each ladder rung.

It is also generally known from the prior art to provide the automatic latching mechanisms with automatic release actuators to allow for automatic release of the automatic latching mechanisms and collapsing of the ladder assembly. For example patent publication WO9115651 discloses an auto release mechanism in the form of triangular shaped actuators on the top side of a ladder rung, which actuators cooperate with part of the locking pin of the automatic latching mechanism of the adjacent upper ladder rung. The actuators push the locking pin into its unlocking positon when the adjacent upper ladder rung is moved towards the ladder rung on which the actuators are provided.

EP2634360 discloses a ladder assembly in which a spacer and an actuator for automatic release of the automatic latching mechanism of an adjacent upper ladder rung have been combined. The actuators for the pivot type automatic release actuators have been mounted upon the spacer body.

A draw back of the prior art is that spacers and actuators for automatic release actuators are often provided as separate elements. When they are combined this is simply an agglomerate of known types of spacers and actuators and thus take up extensive space inside the rung. This is a drawback, since the available space within a rung is limited.

It is an object of the first aspect of the invention to provide a ladder assembly comprising spacers and automatic release actuators that are integrated such that they require little space within the rungs, preferably such that they can be provided below a locking pin of an automatic latching mechanism.

According to the present first aspect of the invention, this object is achieved by providing a ladder assembly as described below.

According to the first aspect of the invention, the ladder assembly is characterized in that the spacers are each located at the top side of their ladder rung and against a stile member of the adjacent upper ladder section, and each extend along said stile member in an upward direction between a base, which base is located at the top of the rung, and a top end, which top end is provided with a slanted actuating surface, which actuating surface is at its top end located adjacent the stile member and veers away from the stile member in the downward direction, wherein the ladder rung of an intermediate ladder section is at its bottom side at both ends provided with a slanted support surface, extending parallel to and vertically above the actuating surfaces of the spacers of the adjacent lower ladder section, such that when the ladder assembly is in its collapsed positon, the support surfaces rest against the actuating surface of the spacers of the adjacent lower ladder section, to keep the ladder rungs at a predetermined anti-finger pinching distance, wherein the automatic release actuators are sliding actuators moveably supported for movement along a rung in a longitudinal direction thereof, and wherein the automatic release actuators are each provided with a slanted actuating surface extending parallel to the actuating surface of the spacer of the adjacent lower ladder section, and wherein said actuating surface of the release actuator, when the automatic release actuator is in its rest position, is located vertically above the actuating surfaces of the spacers of the adjacent lower ladder section, and wherein, when a ladder rung is moved towards the ladder rung of an adjacent lower ladder section, the activation surfaces of the spacers of the ladder rung of the adjacent lower ladder section first contacts the actuating surfaces of sliding automatic release actuators, pushing the sliding automatic release actuators into their unlocking position, and subsequently contact the support surfaces of the ladder rung, positioning the ladder rung at a predetermined anti-finger pinching distance from the ladder rung of the adjacent lower ladder section.

Each spacer is provided with an actuating surface for both activating the release mechanism of an adjacent upper ladder rung and for supporting the adjacent upper ladder rung at an anti-finger pinching distance from the ladder rung. To enable the spacer to release the latching mechanism of the adjacent upper ladder rung as well as support the rung at a predetermined anti-finger pinching distance from the rung the spacer is provided on, the sliding release actuator is positioned with its actuating surface between the actuating surface of the spacer and the support surface of the adjacent upper ladder rung, when the latch mechanism of the upper adjacent ladder rung is locked.

Thus, providing a spacer with an actuating surface for both engaging the support surface of the adjacent upper ladder rung and for engaging the actuating surface of a release mechanism of that upper ladder rung, which actuating surface is provided below that support surface, allows for a compact configuration of the spacer and release mechanism which does not require much space inside the rung of the ladder section.

In an embodiment, the ladder stile members each have a circular cross section comprising a flat section facing the rung, which flat section extend substantially perpendicular to a longitudinal axis of the rung, and wherein the spacers are each positioned against this flat section of the ladder stile members. The flat wall section of the stile member provides an optimal lateral support for the spacers, and prevents the spacers from is provided with a flat wall section for supporting the spacer in a lateral direction. This is beneficial since the spacers, during the collapse of the ladder assembly, are subjected to a substantial load when they block the adjacent upper ladder section at a predetermined anti-finger pinching distance from further advancing. Because both the actuating surface of the spacer and the support surface of the adjacent upper ladder rung extend at an angle with the stile members of the ladder, a substantial part of the compressive forces exerted onto the spacer, either on impact when the ladder sections are moved into their collapsed position or when the ladder is in its collapsed positon, is directed in a lateral direction towards the stile member. This reduces the chance that the spacer gets damaged. When the stile member is provided with a flat contact surface, this load can be optimally transferred from spacer to stile member.

In a further embodiment, the flat wall section is provided with a central recess, extending along the length of the stile member, and the spacers are partially located in said recess. Such a recess provides additional support for the spacer.

In an embodiment, the support surfaces of a ladder rung are located below the locking pins of the latching mechanism of said ladder rung, preferably centrally below the locking pins. It is observed a latching mechanism typically comprises a single locking pin, which locking pin located at the center of the rung. By providing a sliding release actuator with an activation surface located below the support surface, the first aspect of the invention enables to provide the support surface below the pin and thus locate the spacer at the center of the rung, which in turn provides a compact configuration of the spacer, automatic release actuator, latch mechanism assembly.

It is observed that the first aspect of the invention thus allows for providing the slanted actuating surface of the automatic release actuator and the slanted support surface of the adjacent upper ladder rung below the locking pin, which is typically provided in the center of the rung. Thus, the first aspect of the invention allows for a providing the spacers in a central position on a rung, i.e. directly below the locking pin when seen in top view. This positon of the spacer allows for providing a narrow spacer which preferably is combined with stile members having a flat section that functions flat support surface for said spacer, as was explained above. It is noted that a centrally mounted spacer allows for providing the stile member with a relative narrow flat support surface for said spacer.

In an alternative embodiment, the support surfaces of a ladder rung are located level with or even above the locking pins of the latching mechanism of said ladder rung. In such an embodiment, the automatic release slide is located, when seen in top view, adjacent the pin. In a further embodiment, each latch mechanism is provided with two automatic release slides, one at each side of the locking pin. Preferably both the slides are located lateral of and adjacent to the locking pin. In such an embodiment, the spacer is provided with two top ends, for example is substantially U-shaped, which two top end each engage an actuating surface of the automatic release slide, and, when the ladder assembly is in a collapsed condition, extend in the upward direction on the opposite sides of the locking pin.

In a further embodiment, the automatic release actuator is provided with a single slide, which slide moveably supports the locking pin, and extends on both sides of the locking pin in a lateral direction. Such a slide is preferably provided with two actuating surfaces, one on each side of the locking pin.

In an embodiment, the connector is made out of plastic using the injection moulding technique, and wherein the connector is at its top provided with a spacer, and at its bottom side provided with the support surface, which spacer and support surface form an integral part with the connector.

In an embodiment, the locking pin is reciprocally supported in the connector member, e.g. with a spring between the locking pin and the connector member to bias the pin toward its locking position, and each connector member is provided with an actuator connected to the locking pin, e.g. to allow actuation thereof by a thumb of a user or to allow for actuation by contact with a lower positioned ladder section.

In an embodiment, each rung is provided with a recess comprising the support surface, which recess preferably is a one side open chamber in the bottom of the connector, wherein the support surface forms the top wall of a said chamber, and wherein one sidewall of the chamber is formed by the stile member.

In an embodiment the sliding automatic release actuators are provided below the rung, i.e. on the outside thereof, and extend through a slot in the bottom wall of the rung and/or connector into the interior of the rung and/or connector. In this embodiment, the actuating surface of the automatic release actuators is thus also provided outside the ladder rung and the connector. The automatic release actuators each have an extension, entering the rung and/or connector, for coupling the actuator with the locking pin, for example include a snap provision adapted to snap around a rod-shaped locking pin. In an embodiment, the automatic release actuator is made out of plastic using the injection moulding technique.

In an alternative embodiment, the automatic release actuators are provided inside the rung, for example are slideable supported in the connector, which part of the connector is inserted into a cylindrical rung body, for example an aluminium extruded ladder rung.

In an embodiment, the ladder rungs are at their bottom side provided with an elongated recessed portion extending over the length thereof, and the automatic release actuators are arranged in said recessed portion. Thus, the automatic release actuators are substantially protected from accidental contact with a hand or food of a person climbing the ladder, which contact, if forcefully, may damage the automatic release actuator and/or its functioning.

In an embodiment, each connector is at it's stile member portion provided with a ring shaped section for receiving the stile member of a ladder section, which is to be inserted into the ladder rung.

In an alternative embodiment, the stile member portion of the connectors comprises a front and a rear collar segment, each integral at one end thereof with the rung portion, the two collar segments substantially encircling the stile member, the collar segments having spaced apart opposed ends, a fastener being provided bridging the opposed ends of the collar segments for securely coupling the collar segments around the stile member, In an embodiment, the rung of each intermediate ladder section is, in addition to the automatic release actuators, provided with one or more manually operable release actuators connected to the latch mechanisms of the rung to allow for manual unlocking of the stile members of said adjacent higher ladder section by a user in order to allow for a section-by-section manually release and collapsing of the ladder assembly.

It is observed that the slanted actuating surfaces and support surfaces preferably make an angle with the horizontal of at least 35 degrees, preferably an angle in the range of 40-70, more preferably in the range of 40-60 degrees, for example an angle of about 45 degrees.

The first aspect of the invention furthermore provides a loft ladder including a ladder assembly according to the first aspect of the invention.

The first aspect of the invention furthermore provides a stepladder having a first stepladder assembly and a second stepladders assembly hinged to one another so as to be in a storage position folded against one another and an operative position similar to an inverted V at least one of the stepladder assemblies being a ladder assembly according to the first aspect of the invention.

The first aspect of the invention furthermore provides a work platform including a ladder assembly according to the first aspect of the invention.

Advantageous embodiments of the ladder assembly according to the first aspect of the invention are disclosed in the description, in which the first aspect of the invention is further illustrated and elucidated on the basis of a number of exemplary embodiments, of which some are shown in FIGS. 1-11 of the schematic drawings.

According to a second aspect, the present invention relates to a telescopically extendable and collapsible ladder assembly having a top ladder section, a bottom ladder section, and one or more intermediate ladder sections.

The top ladder section and each of the one or more intermediate ladder sections have two tubular stile members arranged parallel to each other and interconnected at a top end by a ladder rung to form a U-shaped ladder section. The bottom ladder section has two tubular stile members arranged parallel to each other and interconnected by a top ladder rung and a bottom ladder rung.

The ladder rungs are made from an aluminium tubular profile, for example an extruded aluminium profile, the profile including a top wall, a bottom wall, as well as a front and a rear wall extending between the top wall and the bottom wall.

The stile members of the top ladder section and the one or more intermediate ladder sections are telescopically inserted into the stile members of an adjacent lower ladder section, so that the one or more intermediate ladder sections and the top ladder section can be collapsed in a collapsing direction towards the bottom ladder section.

The top rung of the bottom ladder section and the rung of each of the one or more intermediate ladder sections are provided at each end with an automatic latch mechanism, said automatic latch mechanisms being adapted for automatically locking the stile members of the adjacent higher ladder section in a fully extended position of said adjacent higher ladder section.

The automatic latch mechanisms of the intermediate ladder sections are each associated with a release actuator for unlocking the stile members of an adjacent higher ladder section in order to allow for, preferably automatic, release and collapsing of the ladder assembly.

The automatic latch mechanisms of the bottom ladder section are each associated with a manually operable release actuator for unlocking of the stile members of the adjacent higher ladder section by a user in order to allow for a manually release and collapsing of the ladder assembly.

Telescopic ladder assemblies have become quite popular as portable ladders, such as a straight telescopic ladder or a step ladder, but also for stationary mounting, such as a loft ladder providing access to a loft. The tubular stile members are commonly made of extruded aluminium profiles, e.g. of circular, oval, square, or other cross-sectional shape.

Prior art designs of telescopic ladder assemblies have already been disclosed as early as 1929 in the U.S. Pat. No. 1,712,942 (Smith) and 1940 in the U.S. Pat. No. 2,194,856. A more recent design is for example disclosed in WO2009057995 (Lampe).

U.S. Pat. Nos. 1,712,942 and 2,194,856 each disclose a telescopic ladder with the actuators in the form of pin shaped finger pieces. In U.S. Pat. No. 1,712,942 the actuators extend through a slot in the bottom wall of the rung. In U.S. Pat. No. 2,194,856 the actuators are provided in the bottom side recess of a U-shaped rung. In both designs, the finger pieces only extend a slight distance below the rungs, which impedes the ease of engaging and manipulating the finger pieces, more in particular impedes operating them with a single hand, e.g. by thumb and index finger.

WO2009057995 discloses a telescopic ladder in which in that the actuators are arranged centrally on the front side of the rung so as to be operable simultaneously with a single hand. The front wall of the rung has an elongated recessed portion over the length thereof and the actuators are arranged in said recessed portion. Arranging the actuators in the elongated recessed portion has the advantage that the actuators are generally protected from the feet of a person on the ladder, yet can have a suitable thickness to be operated by a single hand, e.g. by thumb and index finger.

The present second aspect of the invention aims to provide an improved ladder assembly, or at least a useful alternative, that facilitates user actuation of the manually operable release actuators for the purpose of operating the latch mechanisms and preferably allows for better handling of a ladder assembly in the collapsed state.

According to the second aspect of the invention, this feature is achieved by a telescopically extendable and collapsible ladder assembly, which is characterized in that the top rung of the bottom ladder section is at its bottom side provided with a centrally arranged grip element, the grip element including a front wall, a back wall, as well as a bottom wall extending between a bottom end of the front wall and a bottom end of the back wall, wherein the bottom wall of the grip element extends substantially parallel to the bottom wall of the top rung and provides a grip surface at a distance from the bottom wall of the top rung, which grip surface allows for engaging the collapsed ladder by hand using said grip surface; wherein the grip element forms a housing for the manually operable release actuators of the bottom ladder section, which manually operable release actuators are accessible at lateral sides of the grip element, preferably such that the two manually operable release actuators are operable simultaneously with a single hand of the user, which manually operable release actuators extend through a slot in the bottom wall of the rung into the interior of the rung, each of said release actuators being connected to a linkage member, e.g. a linkage rod, which extends inside the rung to a latch mechanism at the outer end of the rung, and which manually operable release actuators are each movable, parallel to the front wall and the back wall of the grip element and along the bottom wall of the rung, between a rest position and an actuated positon, to allow for manually operating the latch mechanisms and unlocking the stile members of the adjacent higher ladder section by pushing the manually operable release actuators towards each other and into the grip element.

Integrating the actuators in a grip element located below the rung has the advantage that the actuators are generally protected from the feet of a person mounting the ladder, yet can have freely accessible grip surface of a suitable height to be operated by a single hand, e.g. by thumb and index finger, and allow for engaging the rung at the bottom side by hand to carry the ladder when in a collapsed state without pinching the fingers and/or risk multiple fingers getting clamped between the two actuators.

It has furthermore been found that providing a grip element that increases the cross section of the rung is especially comfortable when engaging the rung by hand to carry the collapsed ladder assembly. To carry the ladder, rung of the ladder is typically engaged such that the bottom side of the rung rests in the hand, more in particular the inside of the fingers which is a particular delicate area of the hand. Providing a grip element according to the second aspect of the invention, which protrudes relative to the bottom surface of the rung, allows for supporting the ladder with the fingers of the hand while resting the grip element and/or the rung against the palm of the hand. This provides additional stability which in turn enhances the feeling of comfort with the person carrying the ladder.

Thus, the present second aspect of the invention provides an improved ladder assembly, or at least a useful alternative, that facilitates user actuation of the manually operable release actuators for the purpose of operating the latch mechanisms and allows for better handling of a ladder assembly in the collapsed state.

In an embodiment according to the second aspect of the invention the manually operable release actuators preferably are bar-shaped, having a longitudinal axis extending parallel to a longitudinal axis of the rung, and have a grip surface at an actuating end for pushing the actuator into the grip element, and a grip surface at their bottom side that essentially forms an extension of the grip surface of the grip element. Due to their bar shape, the release actuators essentially form an extension of the grip element.

Furthermore, when in their rest positon, the manually operable release actuators are accessible at lateral sides of the housing, in an embodiment extend at opposite sides out of the grip element, and are to be pushed into the housing to unlock the stile members of the adjacent higher ladder section. One end of the bar shaped actuator is the actuating end, i.e. the end to be engaged by a user when pushing the actuator into the grip element. The other end of the bar shaped actuator is located inside the housing, even when the actuator is in its rest position. In a further embodiment, the manually operable release actuators are bar shaped, and have, between the actuating end and the other end, a substantially continuous cross section with a shape complementary to the shape of the openings in the grip element. Thus, when the actuator is pushed into the housing, there is no risk of elements, for example a finger, getting stuck between a part of the actuator and the grip element.

In an embodiment, the top bar shaped release actuators are located adjacent the bottom wall of the rung, such that when engaged by hand when the collapsed ladder assembly is carried, they contact the bottom wall of the rung and thus enable direct force transfer, caused by the weight of the ladder assembly, from release actuator to rung.

In a further preferred embodiment, the bottom side of the bar shaped release actuators has a shape similar to the shape of the bottom side of the grip element, both can for example be barrel shaped, to further complement the grip surface of the grip element.

In an embodiment, the actuating end of the manually operable release actuators, i.e. the end providing the grip surface to be engaged by a user when pushing the actuator into the grip element, has, when seen in a bottom view, a curved surface. In such an embodiment, the grip surface of the manually operable release actuators is curved towards the front and the back of the grip element, such that, when seen in bottom view, the actuating end for pushing the actuator has a semi circular or semi oval shape. Thus, there is no sharp angled transition between the grip surface and the front surface of the bar shaped actuator. This facilitates engagement with a single hand, in particular when engaging the respective contact surfaces with thumb and index finger, and reduced peak pressures in those fingers at the transition area between contact surface and front surface of the manually operable release actuators.

The grip surfaces of the release actuators and the grip element are preferably provided with a grip enhancement in the form of, for example, a web of rib shaped protrusions, recesses, providing a flexible and/or rough surface layer, etc.

In an embodiment the grip element is mounted against the bottom wall of the top rung. In such an embodiment the top end of the front wall and the back wall of the grip element abut the bottom wall of the top rung.

In an alternative embodiment, the front wall and the back wall of the grip element overlap with the front wall and the back wall of the rung, such that the grip area provided by the grip element overlaps with the front and back of the rung. Thus there is no risk of a slid between the grip surface defined by the grip element and the bottom wall of the top rung, in which skin or fabric met get pinched when lifting the ladder assembly by hand.

In a further embodiment, the manually operable release actuators are bar shaped and have a width in a direction perpendicular to the front wall and the back wall of the grip element, and wherein the width of the bar shaped release actuator is substantially similar to the width of the rung to which the grip element is mounted.

In an embodiment, the Grip element comprises a U-shaped profile that forms the front wall, back wall, and bottom wall of the grip element. The U-shaped profile can be mounted directly onto the rung, for example using nuts and bolts, rivets, or click fingers engaging openings provided in the rung, etc. In a further embodiment, the U-shaped profile is combined with other elements, for example a base element that is to be mounted on the rung and in turn forms a mount for the U-shaped profile.

Preferably, the grip element is made out of plastic using the injection moulding technique. In an embodiment, the grip element is made out of a plastic material using the injection moulding technique, preferably the grip element is an injection moulded essentially U-shaped element, which U-shaped element comprises the front wall, the back wall and the bottom wall of the grip element. In an alternative embodiment, the grip element comprises a U-shaped profile, preferably an extruded aluminium U-shaped profile, the profile including the front and wall and the back wall and the bottom wall of the grip element. Thus a substantially U-shaped element can be provided which is to be mounted to the rung, for example by way of click fingers that engage openings in the rung, and/or screws, bolts or rivets.

The manually operable release actuators are preferably made out of plastic using the injection moulding technique. In an embodiment, the actuators are box shaped, having a bottom, four walls and an open top, and are mounted in the grip element with the open top facing the bottom wall of the rung.

The grip element, more in particular the front wall, the back wall and the bottom wall of the grip element, define a housing volume for receiving the manually operated actuators when pushed into their actuated position. In an embodiment, the slot or slots, through which the manually operable release actuators extend into the interior of the rung are located in the central area of the rung that is covered by the grip element and the actuators when in their actuated position. Thus, the slots are covered independent of the position of the manually operable release actuators, and therefore protected from the surrounding environment, more in particular from foreign elements from entering the slots and hampering the movement of the actuators and/or the functioning of the latch mechanisms located in the rung.

In an embodiment, the manually operable release actuators each have an extension for coupling the actuator with the linkage member, for example includes a snap provision adapted to snap around a rod-shaped linkage member. Preferably, the extensions and the slots are dimensioned such that, during assembly, the extensions can be inserted into the slots to be coupled with the linkage members.

In an embodiment, the latch mechanisms and/or the actuators are provided with one or more spring elements, such as helical springs, that bias the release actuators towards their rest positions. Thus, a release actuator is moved back into it's extend position by the spring elements, after it has been pushed into the grip element by the user to unlock the stile members of the adjacent higher ladder section. In a further embodiment, the latch mechanisms provided in the top rung each include a spring biased locking element, for example a locking pin, which spring element also functions as the spring element that biases the release actuator into its rest position.

In an embodiment, the grip element extends at least 8 mm below the bottom wall of the top rung, preferably between 10 mm and 25 mm below the bottom wall of the top rung, for example 20 mm below the bottom wall of the top rung.

In an embodiment, the grip element, more in particular the grip surface provided by the grip element, has a length parallel to a longitudinal direction of the rung, which length is at least 40 mm, is preferably between 50 mm and 80 mm, preferably is 75 mm.

In an embodiment, the manually operable release actuators have a height of at least 6 mm, preferably have a height between 10 mm and 25 mm, for example have a height of 17 mm.

In an embodiment, the manually operable release actuators have a width in a direction perpendicular to the front wall and the back wall of the grip element, and wherein the width of the bar shaped release actuator is at least 5 mm, preferably at least 10 mm, more preferably is between 15 mm and 40 mm, for example is 35 mm.

In an embodiment, the manually operable release actuators, at the end facing the rung, have a grip surface for engagement by a user, and wherein the distance between those grip surfaces, when the release actuators are in a rest position, is at least 80 mm preferably is between 90 mm and 140 mm, for example is 110 mm.

In an embodiment, the manually operable release actuators, when the release actuators are each in their rest position, protrude at opposite sides of the grip element at least 5 mm from the grip, preferably at least 10 mm, more preferably between 12 and 20 millimeters, for example 17 mm.

In an embodiment, all the latch mechanisms provided at each end of the rungs of the intermediate ladder sections are automatic latch mechanisms, of which the release actuators are arranged for cooperating with an actuator pin provided on the rung of an adjacent lower ladder section for automatically unlocking the automatic latch mechanism when the ladder section is moved in a collapsing direction towards the adjacent lower ladder section. In such an embodiment, only manual operation of the manual operably release actuators is need for collapsing the ladder assembly. Especially in combination with single hand use, this allows for easy handling of the ladder assembly.

In an embodiment, the rung of each intermediate ladder section is provided with one or more manually operable release actuators connected to the latch mechanisms of the rung to allow for manual unlocking of the stile members of said adjacent higher ladder section by a user in order to allow for a section-by-section manually release and collapsing of the ladder assembly. In a further embodiment, the rungs are provided with both automatic latch mechanisms of which the release actuators are arranged for cooperating with an actuator pin provided on the rung of an adjacent lower ladder section, as described above, and manually operable release actuators.

In an embodiment each ladder rung is connected at each end thereof to the stile member via a connector member, the locking pin being reciprocally supported in the connector member, e.g. with a spring between the locking pin and the connector member to bias the pin toward its locking position, and each connector member being provided with an actuator connected to the locking pin, e.g. to allow actuation thereof by a thumb of a user or to allow for actuation by contact with a lower positioned ladder section.

The second aspect of the invention furthermore provides a loft ladder including a ladder assembly according to the second aspect of the invention.

The second aspect of the invention furthermore provides a stepladder having a first stepladder assembly and a second stepladders assembly hinged to one another so as to be in a storage position folded against one another and an operative position similar to an inverted V at least one of the stepladder assemblies being a ladder assembly according to the second aspect of the invention.

The second aspect of the invention furthermore provides a work platform including a ladder assembly according to the second aspect of the invention.

Advantageous embodiments of the ladder assembly according to the second aspect of the invention are disclosed in the description, in which the second aspect of the invention is further illustrated and elucidated on the basis of a number of exemplary embodiments, of which some are shown in FIGS. 12-17 of the schematic drawings.

DETAILED DESCRIPTION OF THE INVENTION

Figure 1:
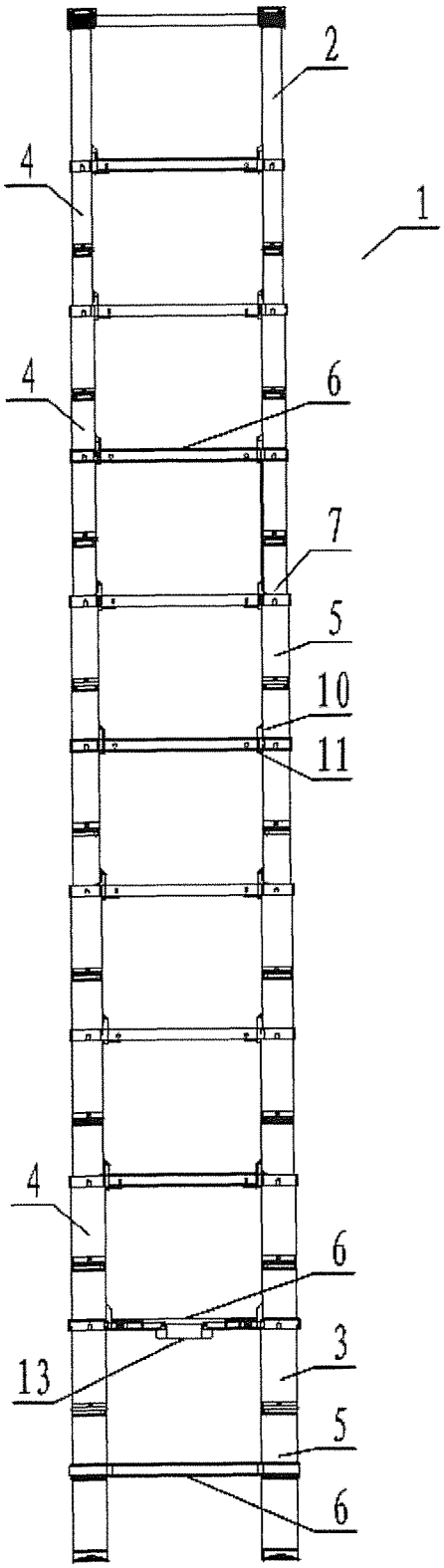
FIG. 1 shows a frontal view of a telescopic extendable and collapsible ladder assembly according to the first aspect of the invention, in an extended condition.

FIG. 1 shows a frontal view of a telescopic extendable and collapsible ladder assembly 1 according to the first aspect of the invention, in an extended condition. The ladder assembly 1 has a top ladder section 2, a bottom ladder section 3, and multiple intermediate ladder sections 4.

The stile members of the top ladder section 2 and of the one or more intermediate ladder sections 4 are telescopically inserted into the stile members of an adjacent lower ladder section, so that the multiple intermediate ladder sections and the top ladder section can be collapsed in a collapsing direction towards the bottom ladder section.

The top ladder section 2 and each of the multiple intermediate ladder sections 4 have two tubular stile members 5 arranged parallel to each other and interconnected at a top end by a ladder rung 6 to form a U-shaped ladder section. The bottom ladder section 3 has two tubular stile members 5 arranged parallel to each other and interconnected by a top ladder rung 6' and a bottom ladder rung 6".

The ladder rungs 6,6',6" are made from an aluminium tubular profile, the profile including a top wall, a bottom wall, as well as a front and a back wall extending between the top wall and the bottom wall.

Figure 2:
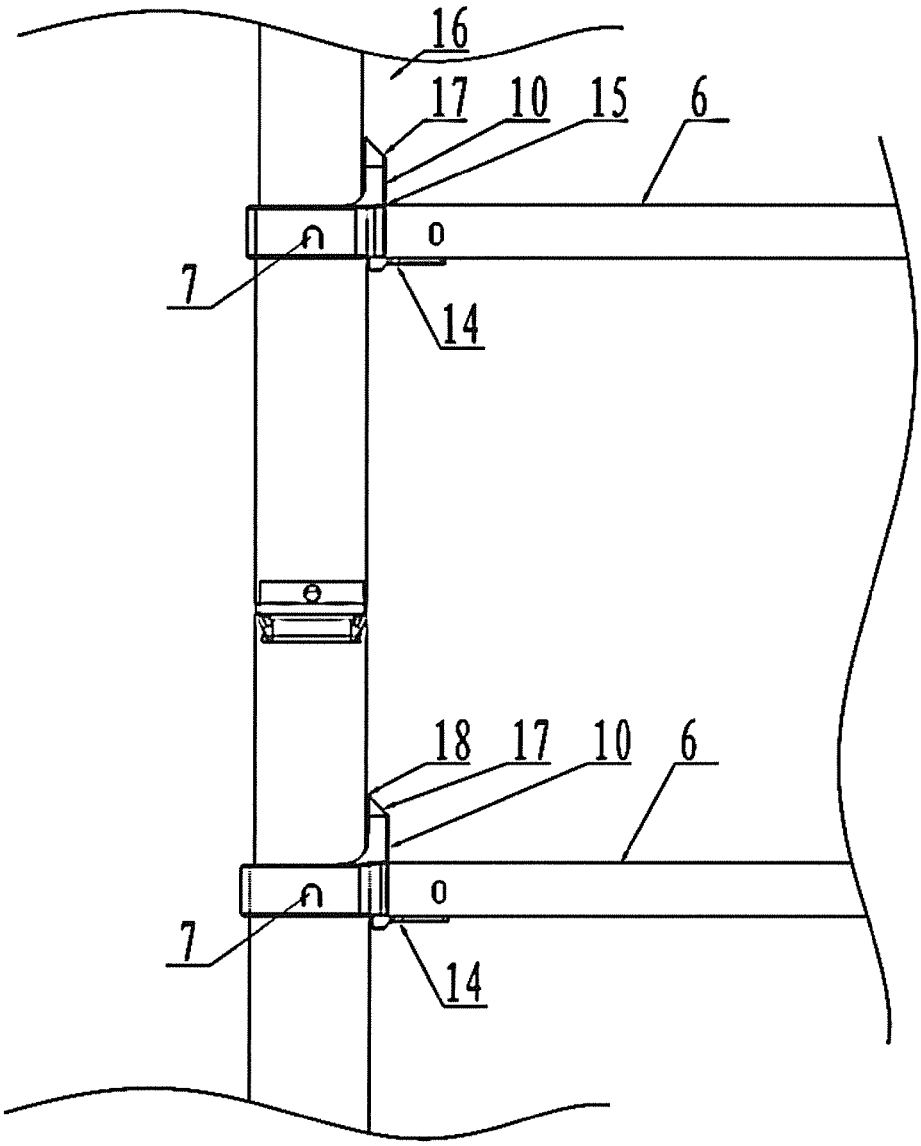
FIG. 2 shows a frontal view in close up of two ladder rungs, each connected to a stile member via a connector, of the ladder assembly of FIG. 1.
Figure 7:
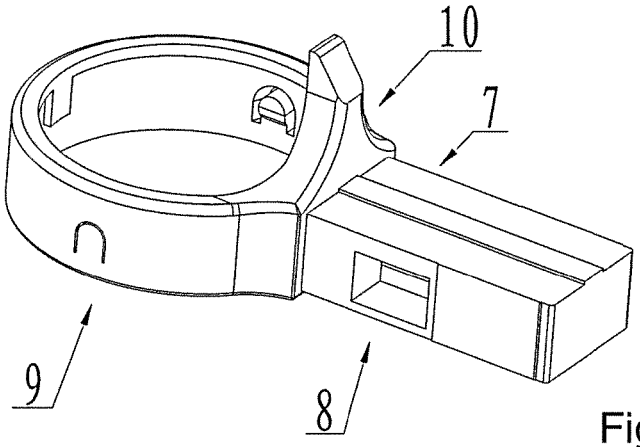
FIG. 7 shows a perspective view from above of a connector of a ladder assembly according to the first aspect of the invention.
Figure 8:
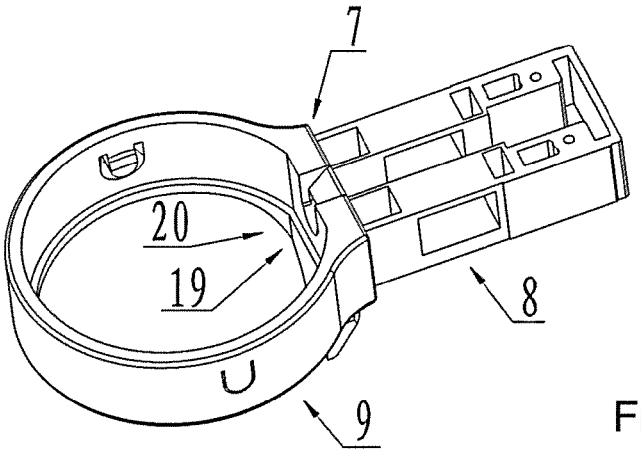
FIG. 8 shows a perspective view from below of a connector of the connector of FIG. 7.

FIG. 2 shows a frontal view in close up of two ladder rungs 6 of the ladder assembly of FIG. 1. Each ladder rung is connected to a stile member 5 via a connector 7. Each ladder section 2,3,4 includes a connector 7 at each end of a rung 6,6',6". FIG. 7 shows a perspective view from above of a connector 7 of a ladder assembly according to the first aspect of the invention. FIG. 8 shows a perspective view from below of a connector of the connector of FIG. 7. The connector 7 has a rung portion 8, in use connected to the end of a ladder rung, and a stile member portion 9, in use connected to one of the stile members of a ladder section.

In the exemplary embodiment shown, the connector is at it's stile member portion 9 provided with a ring shaped section for receiving the stile member 5 of a ladder section, which is to be inserted into the ladder rung.

The top rung 6' of the bottom ladder section 3 and the rung 6 of each of the multiple intermediate ladder sections 4 are all provided at, each end of the ladder rung 6',6, with a spacer 10 for, when the ladder assembly 1 is in a collapsed condition, supporting the adjacent upper ladder rung 6 at a predetermined anti-finger pinching distance from the ladder rung 6' ,6" on which the spacer has been provided. This, to prevent fingers from getting pinched between the ladder rungs when the ladder assembly is brought into its collapsed position. In an embodiment, this anti-finger pinching distance is for example 2 cm measured between the top wall of a ladder rung and the bottom wall of an adjacent upper ladder rung.

Figure 11:
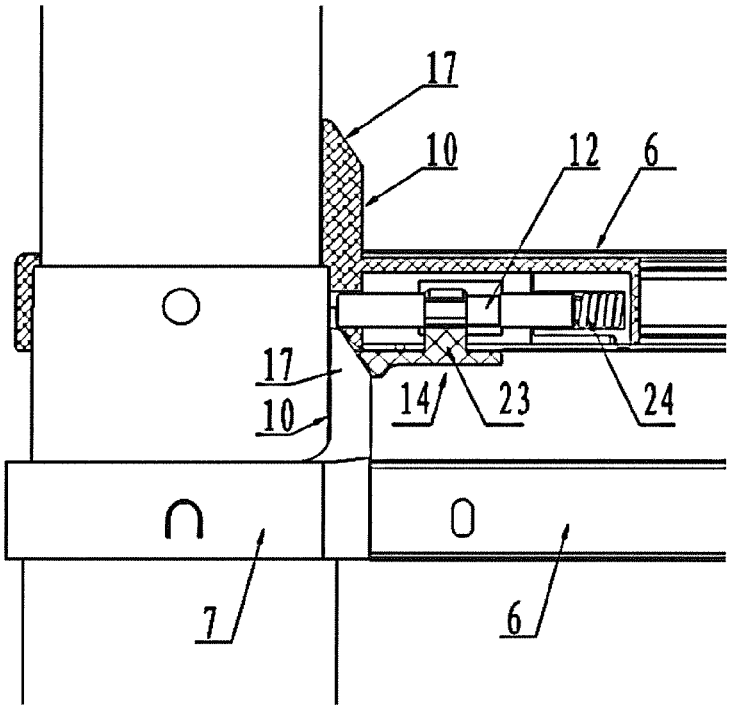
FIG. 11 shows a frontal view in cross section of the bottom ladder section and the adjacent upper ladder section of FIG. 5.

The top rung 6' of the bottom ladder section 3 and the rung 6 of each of the multiple intermediate ladder sections 4 are provided at each end with an automatic latch mechanism 11. The automatic latch mechanisms 11 are adapted for automatically locking the stile members 5 of the adjacent higher ladder section in a fully extended position of said adjacent higher ladder section. FIG. 11 shows a frontal view in cross section of the bottom ladder section 3 and the adjacent upper ladder section 4, also shown in FIG. 5, in which the automatic latching mechanism 11 provided at the end of the ladder rung of the intermediate ladder section is visible.

The automatic latching mechanisms in the ladder rungs of the ladder assembly 1 are typically all substantially similar in design. The automatic latch mechanisms 11 comprise a locking pin 12, which locking pin is moveably supported for movement along a rung 6',6 , i.e. in a longitudinal direction thereof, between a locking positon, in which an end of the locking pin 12 is inserted in an opening provided in the stile member 5 of the adjacent upper ladder section to lock the stile members 5 relative to each other, and an unlocking position, depicted in FIG. 11, in which said end of said locking pin 12 is retracted from said opening. Each locking pin 12 is biased towards the stile member, i.e. towards the locking position, preferably by way of a spring element, for example a helical spring 13 as depicted in FIG. 11. A manually operable release actuator and/or an automatic release actuator are/is provided for moving the locking pin into its unlocking position.

Figure 9:
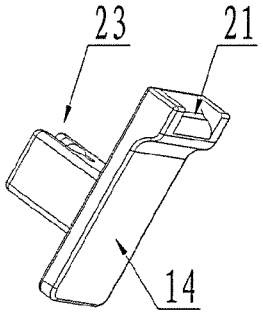
FIG. 9 shows a perspective view from below of a connector of automatic release actuator of a ladder assembly according to the first aspect of the invention.
Figure 10:
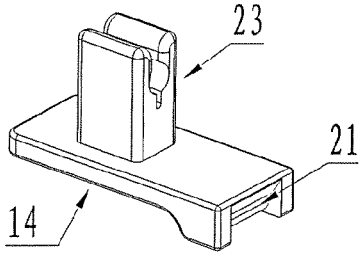
FIG. 10 shows a perspective top view from above of the automatic release actuator of FIG. 9.

In the exemplary embodiment shown, the sliding automatic release actuators 14 are provided below the rungs 6,6', i.e. on the outside thereof, and extend through a slot in the bottom wall of the rung and connector, see FIG. 11, into the interior of the rung and connector. In this embodiment, the slanted actuating surface 21 of the automatic release actuators 14 is thus also provided outside the ladder rung and the connector. In the particular embodiment shown, the automatic release actuators 14 each have an extension, entering the rung 6 and connector 7, for coupling the automatic release actuator 14 with the locking pin 12. In the embodiment shown, the extension includes a snap provision 23 adapted to snap around the rod-shaped locking pin 23, see FIGS. 9 and 10.

The skilled person will appreciate that the body of the connector includes a passage for the locking pin (which can form an extension of or be connected to the automatic release actuator) and allows to accommodate the spring 13 for biasing said locking pin 12 towards it's locked position (the stile member having an associated locking pin opening to receive said locking pin in extended state of the ladder section).

The automatic latch mechanisms 11 of the bottom ladder section 3 each comprise a manually operable release actuator 13, which manually operable release actuators are coupled with the locking pin of the automatic latch mechanisms for unlocking the stile member of an adjacent higher ladder section by moving the locking pin into its unlocking position, in order to allow for collapsing of the ladder assembly.

In the ladder assembly 1 shown, the manually operable release actuators 13 are located centrally on the top ladder rung 6' of the bottom ladder section. In an alternative embodiment, the manually operable release actuators are for example provided at the ends of the ladder rung, or a single manually operable release actuator, connected with both latching mechanisms, is provided at the centre of the rung.

The automatic latch mechanisms 11 of the intermediate ladder sections 4 each comprise an automatic release actuator 14. These automatic release actuators 14 are coupled with the locking pin 12 of the automatic latch mechanisms 11, for unlocking the stile member of an adjacent higher ladder section by moving the automatic release actuator from its rest positon, shown in FIGS. 2, 3 and 4, into its actuated position, shown in FIGS. 5, 6 and 11, and thus moving the locking pin from its locking position into its unlocking position, in order to allow for collapsing of the ladder assembly, According to the first aspect of the invention, the spacers 10 of the ladder assembly 1 are each located at the top side of their ladder rung 6,6' and against a stile member 5 of the adjacent upper ladder section. For example in FIG. 11 it is clearly shown that the spacer rests against the outer surface of the stile member of the adjacent upper ladder section. Thus, when the adjacent upper ladder section is moved towards its collapsed position, it slides along the spacer. The spacers 10 each extend along the stile member in an upward direction between a base 15, which base 15 is located at the top of the rung, and a top end 16, which top end is provided with a slanted actuating surface 17. The slanted actuating surface 17 is at its top end 18 located adjacent the stile member and veers away from the stile member 5 in the downward direction.

According to the first aspect of the invention, the ladder rung 6, e.g. the part of a connector that forms part of the rung, of an intermediate ladder section is at its bottom side at both ends provided with a slanted support surface 19, extending parallel to and vertically above, i.e. in a vertical projection or directly above, the slanted actuating surfaces 17 of the spacers 10 of the adjacent lower ladder section, such that when the ladder assembly is in its collapsed positon, the support surfaces 19 rest against the actuating surfaces 17 of the spacers 10 of the adjacent lower ladder section, as shown in FIG. 11, to keep the ladder rungs at a predetermined anti-finger pinching distance.

In the exemplary embodiment shown, the connector 7 is at its top provided with a spacer 10, and at its bottom side provided with the slanted support surface 19. Furthermore, the connector 7 is made out of plastic using the injection moulding technique, and the spacer 10 and support surface 19 form an integral part with the connector.

Furthermore, in the exemplary embodiment shown, the rung is provided with a recess comprising the support surface 19. The recess is a one side open chamber 20 in the bottom of the connector 7. The support surface 19 forms the top wall of the chamber 20, and one sidewall of the chamber 20 is formed by the stile member 5, see FIG. 8 and FIG. 11.

According to the first aspect of the invention, the automatic release actuators 14 are sliding actuators which are moveably supported for movement along a rung, in a longitudinal direction thereof.

Furthermore, the automatic release actuators 14 are each provided with a slanted actuating surface 21 extending parallel to the slanted actuating surface 17 of the spacer 10 of the adjacent lower ladder section. When the automatic release actuator 14 is in its rest position, the actuating surface 17 of the release actuator 14 is located vertically above, i.e. in a vertical projection or directly above, the slanted actuating surface 17 of the spacer 10 of the adjacent lower ladder section, see for example FIGS. 2-4.

Figure 3:
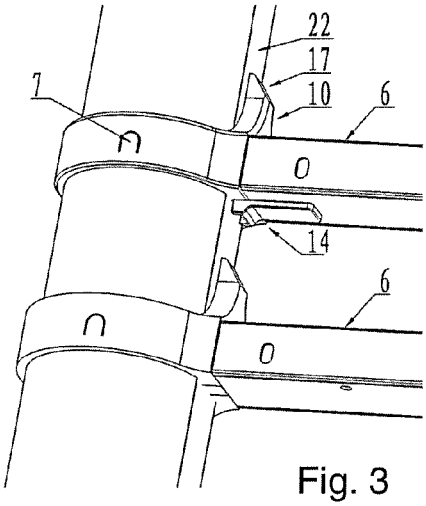
FIG. 3 shows perspective view from below of a top rung of a bottom ladder section and an adjacent upper ladder section a partially inserted in said bottom ladder section.
Figure 4:
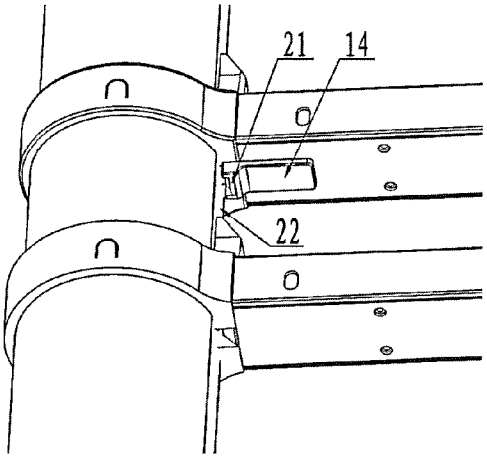
FIG. 4 shows a further perspective view from below of the bottom ladder section and an adjacent upper ladder section of FIG. 3.
Figure 5:
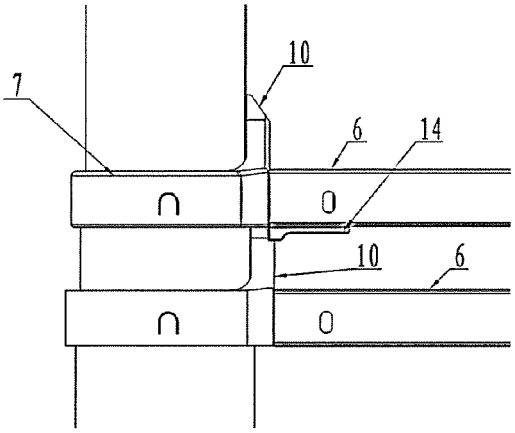
FIG. 5 shows a frontal view of the bottom ladder section and an adjacent upper ladder section of FIG. 3, with the adjacent upper ladder section further inserted in the bottom ladder section.
Figure 6:
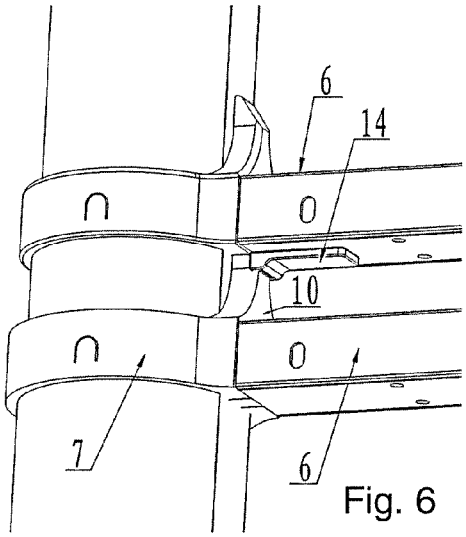
FIG. 6 shows a perspective view from below of the bottom ladder section and an adjacent upper ladder section of FIG. 5.

When a ladder rung 6 is moved towards the ladder rung 6' of an adjacent lower ladder section 3, compare FIGS. 3 and 4 with FIGS. 5 and 6, the slanted activation surfaces 17 of the spacers 10 of the ladder rung 6' of the adjacent lower ladder section 3 first contacts the slanted actuating surfaces 21 of sliding automatic release actuators, pushing the sliding automatic release actuators into their unlocking position, and subsequently contact the slanted support surfaces 19 of the ladder rung 6, positioning the ladder rung 6 at a predetermined anti-finger pinching distance from the ladder rung 6' of the adjacent lower ladder section 3.

Thus, according to the first aspect of the invention, the spacers 10 are each arranged such that—during collapse of the ladder assembly 1—they cooperates with an automatic release actuator 14 of an automatic latch mechanism 11 arranged on an adjacent upper ladder section 4, the locking pin 12 of that locking mechanism being initially biased into its locking position and being moved by said cooperation with the slanted actuating surface 21 against said bias into an unlocking position, said locking pin in said unlocking position allowing for the passage of the stile member of the adjacent ladder section during collapse of the ladder section assembly.

It is observed that in the exemplary embodiment shown, the slanted support surfaces 19 of a ladder rung are located below the locking pins 12 of the latching mechanism of the ladder rung, more in particular are located centrally below the locking pins, see for example FIG. 8.

By providing a sliding release actuator with an activation surface located below the support surface, the first aspect of the invention enables to provide the support surface below the pin and thus locate the spacer at the center of the rung, which in turn provides a compact configuration of the spacer, automatic release actuator, latch mechanism assembly.

In the exemplary embodiment shown, the ladder stile members 5 each have a circular cross section comprising with a flat section 22 facing the ladder rung 6,6',6". The flat section 22 extends perpendicular to a longitudinal axis of the ladder rung 6,6',6". The flat wall section 22 of the stile members 5 provides an optimal lateral support for the spacers 10, which are each positioned against this flat section of the ladder stile members. This is beneficial since the spacers 10, during the collapse of the ladder assembly, are subjected to a substantial load when they block the adjacent upper ladder section at a predetermined anti-finger pinching distance from further advancing. Because both the actuating surface of the spacer and the support surface of the adjacent upper ladder rung extend at an angle with the stile members of the ladder, a substantial part of the compressive forces exerted onto the spacer, either on impact when the ladder sections are moved into their collapsed position or when the ladder is in its collapsed positon, is directed in a lateral direction towards the stile member. This reduces the chance that the spacer gets damaged. When the stile member is provided with a flat contact surface, this load can be optimally transferred from spacer to stile member.

It is observed that the first aspect of the invention allows for providing the actuating surface of the automatic release actuator and the support surface of the adjacent upper ladder rung below the locking pin, see FIG. 11, which is typically provided in the center of the rung. Thus, the first aspect of the invention allows for a providing the spacers in a central position on a rung, i.e. directly below the locking pin when seen in top view. This positon of the spacer allows for providing a narrow spacer, and thus or providing the stile member with a relative narrow flat support surface for said spacer.

Figure 12:
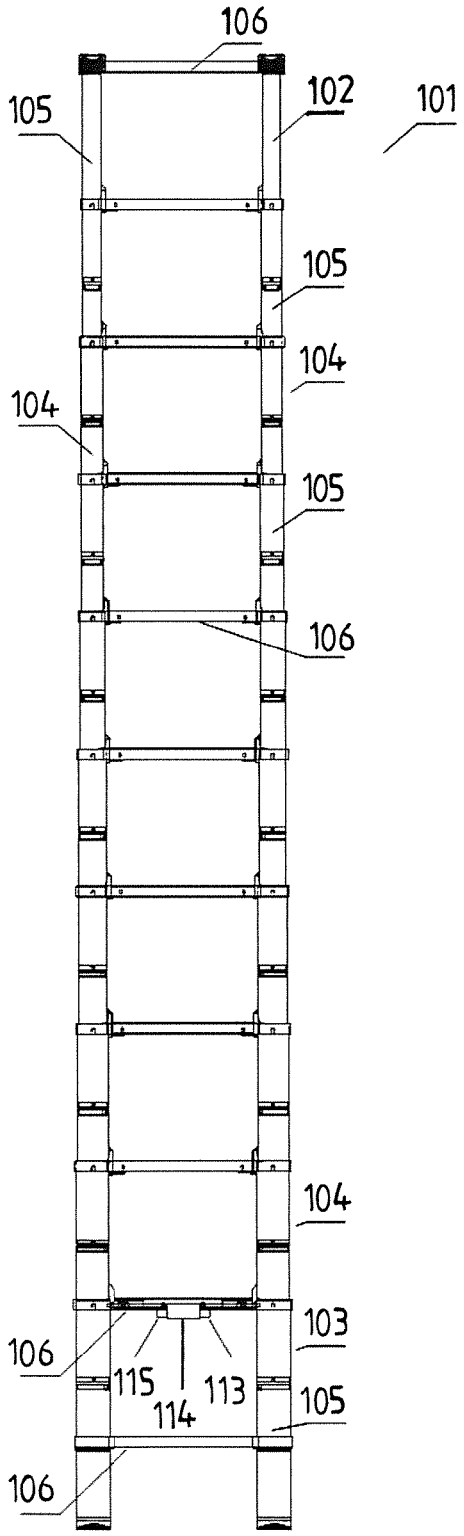
FIG. 12 shows a frontal view of a telescopic extendable and collapsible ladder assembly according to the second aspect of the invention, in an extended condition.

FIG. 12 shows a frontal view of a telescopically extendable and collapsible ladder assembly 101 according to the second aspect of the invention, in an extended condition. The ladder assembly 101 comprises at a top ladder section 102, a bottom ladder section 103, and multiple intermediate ladder sections 104.

The top ladder section 102 and each of the one or more intermediate ladder sections 104 each have two tubular stile members 105 arranged parallel to each other and interconnected at a top end by a ladder rung 106 to form a U-shaped ladder section. The bottom ladder section 103 has two tubular stile members 105 arranged parallel to each other and interconnected by a top ladder rung 106' and a bottom ladder rung 106".

The bottom ladder section 103 is the ladder sections configured for, during use of the ladder, assembly, forming the base of the extended ladder 101. Typically, the bottom end of the tubular stile members 105 of the bottom ladder section 103 are provided with plastic or rubber "feet" that provide a non slippery contact with the support surface onto which the ladder has been mounted.

In the embodiment shown, the ladder rungs 106,106',106" are each made from an extruded aluminium tubular profile, the profile including a top wall 107, a bottom wall 108, as well as a front wall 109 and a back wall 110 extending between the top wall and the bottom wall The stile members 105 of the top ladder section 102 and the intermediate ladder sections 104 are telescopically inserted into the stile members of an adjacent lower ladder section, so that the one or more intermediate ladder sections and the top ladder section can be collapsed in a collapsing direction towards the bottom ladder section 102.

Figure 14:
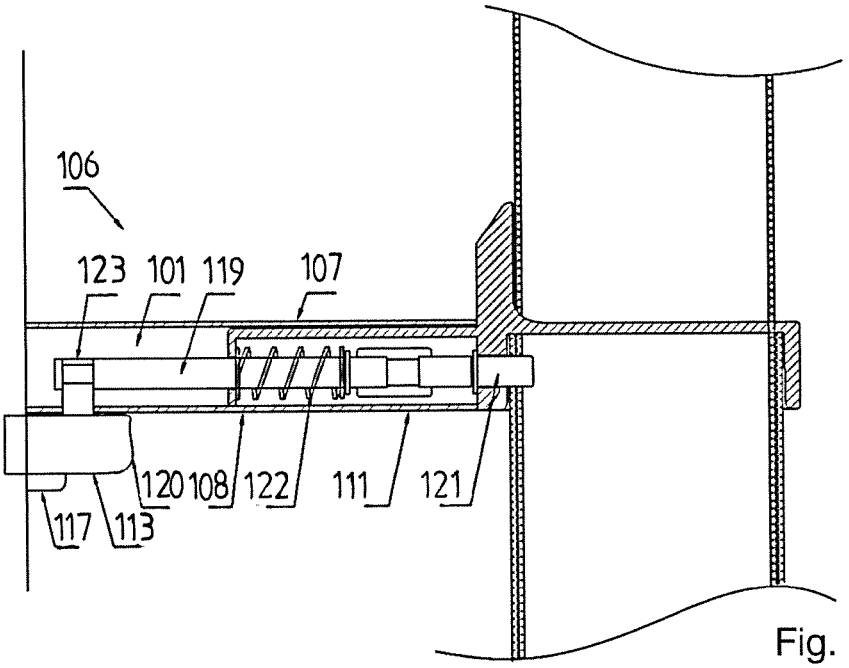
FIG. 14 shows partial frontal view in cross section of the top rung of FIG. 13.

The top rung 106' of the bottom ladder section 103 and the ladder rung 106 of each of the multiple intermediate ladder sections 104 are provided at each end with an automatic latch mechanism 111. The latch mechanisms are provided inside the ladder rungs, and are therefore not visible in FIG. 12 but is depicted in the cross sectional views of FIGS. 14 and 15. The automatic latch mechanism 111 is adapted for automatically locking the stile members 105 of the adjacent higher ladder section in a fully extended position of the adjacent higher ladder section. It is observed that these types of latch mechanisms are as such known in the prior art, and therefore are not discussed in great detail herein.

The automatic latch mechanisms 111 of the multiple intermediate ladder sections 104 are each associated with a release actuator 112 for unlocking the stile members 105 of an adjacent higher ladder section in order to allow for automatic release and collapsing of the ladder assembly 101.

The automatic latch mechanisms 111 of the bottom ladder section 103 are each connected with a manually operable release actuator 113 for unlocking of the stile members 105 of the adjacent higher ladder section, i.e. an intermediate ladder section 104, by a user in order to allow for a manually release and collapsing of the ladder assembly 101

According to the second aspect of the invention, the top rung 106 of the bottom ladder section 103 is at its bottom side provided with a centrally arranged grip element 114. The grip element 114 including a front wall 115, a back wall 116, as well as a bottom wall 117 extending between a bottom end of the front wall and a bottom end of the back wall of the grip element.

The bottom wall 117 of the grip element 114 extends substantially parallel to the bottom wall 108 of the top rung 106' and provides a grip surface 118 at a distance from the bottom wall 108 of the top rung 106', which grip surface 118 allows for engaging the collapsed ladder assembly 101 by hand using said grip surface. The grip element 114 furthermore forms a housing for the manually operable release actuators 113 of the bottom ladder section 103.

The manually operable release actuators 113 extend at opposite sides out of the grip element 114. The manually operable release actuators 113 are each movable, parallel to the front wall 115 and the back wall 116 of the grip element 114 and along the bottom wall 108 of the rung 106', between a rest position, shown in FIGS. 14 and 15, and an actuated positon. At the end facing the rung, the manually operable release actuators 113 have a grip surface 120 for engagement by a user. The grip surface, at least at a central area thereof, extends substantially perpendicular to a longitudinal axis of the rung of the ladder. In the embodiment shown, the two manually operable release actuators 113 are operable simultaneously with a single hand of the user.

The manually operable release actuators 113 extend through a slot in the bottom wall 108 of the ladder rung 106' into the interior of the rung. Each of the actuators 113 is connected to a linkage member, in the embodiment shown a linkage rod 119, which extends inside the ladder rung 106' to a latch mechanism 111 at the outer end of the rung. Thus, by pushing the manually operable release actuators 113 towards each other and into the grip element 114, the latch mechanisms 111 are operated and the stile members 105 of the adjacent higher ladder section 104 are unlocked.

In the embodiment shown, the latch mechanisms 111 provided in the top rung 106' each include a spring biased locking element, in particular a locking pin 121, which is configured for locking the tubular stile members relative to each other and thus secure the ladder assembly 101 in its extended position. Since the latch mechanisms 111, more in particular the locking pin 121 of the latch mechanisms, are coupled to the manually operable actuators 113 via a linkage member, in the embodiment shown linkage rods 119, the spring elements 122 also biases the release actuators 113 into their rest positions. Thus, a release actuator 113 is moved back into it's extend position by the spring elements 122, after it has been pushed into the grip element 14 by the user to unlock the stile members 105 of the adjacent higher ladder section.

In an alternative embodiment, the actuators are provided with one or more spring elements, instead off or in addition to spring elements provided in the latch mechanisms, to bias the release actuators towards their respective rest positions. For example, a biased spring element can be provided in the grip element, with its opposite ends contacting the respective manually operable release actuators, to push them out of the housing into their rest positions.

The second aspect of the invention provides manually operable actuating means with a contact surface that extends substantially perpendicular to the movement of the actuator, which provides optimal grip. In practice, the manually operable release actuators thus function as push buttons provided at opposite ends of the grip element.

The second aspect of the invention furthermore allows for providing the actuators with a large contact area, which reduces the peak pressures in the fingers when pushing the actuators in their actuating direction. This is possible because the actuators are provided below the rung, instead of at the front of the rung, and are integrated in the grip element. The protruding actuators thus do not obstruct movement of a person climbing the ladder and are at the same time protected against accidental contact with the feet of a user.

In an embodiment each ladder rung is connected at each end thereof to the stile member via a connector member, the locking pin being reciprocally supported in the connector member, e.g. with a spring between the locking pin and the connector member to bias the pin toward its locking position.

The skilled person will appreciate that the body of the connector can be provided with a passage for a locking pin (which can form an extension of or be connected to the mentioned rod attached to the slide actuators) and allows to accommodate a spring for biasing said locking pin towards a locked position (commonly the stile member having an associated locking pin opening to receive said locking pin in extended state of the ladder section).

In an embodiment the one or more actuators are arranged on the front side of the rungs of the intermediate ladder sections, e.g. two actuators, each connected to a corresponding locking pin, arranged centrally on the front side of the rung so as to be operable simultaneously with a single hand.

The tubular stile members may have a circular cross-section, but other cross-sectional shapes, e.g. square, rectangular (rounded), triangular, delta shaped, oval, elliptical, etc. are also possible.

In the particular embodiment shown, the manually operable release actuators 113 are bar-shaped, having a longitudinal axis extending parallel to a longitudinal axis of the top rung 106, the bar shaped manually operable release actuators 113 have a grip surface 120 at an actuating end for pushing the release actuator into the grip element 114.

Figure 13:
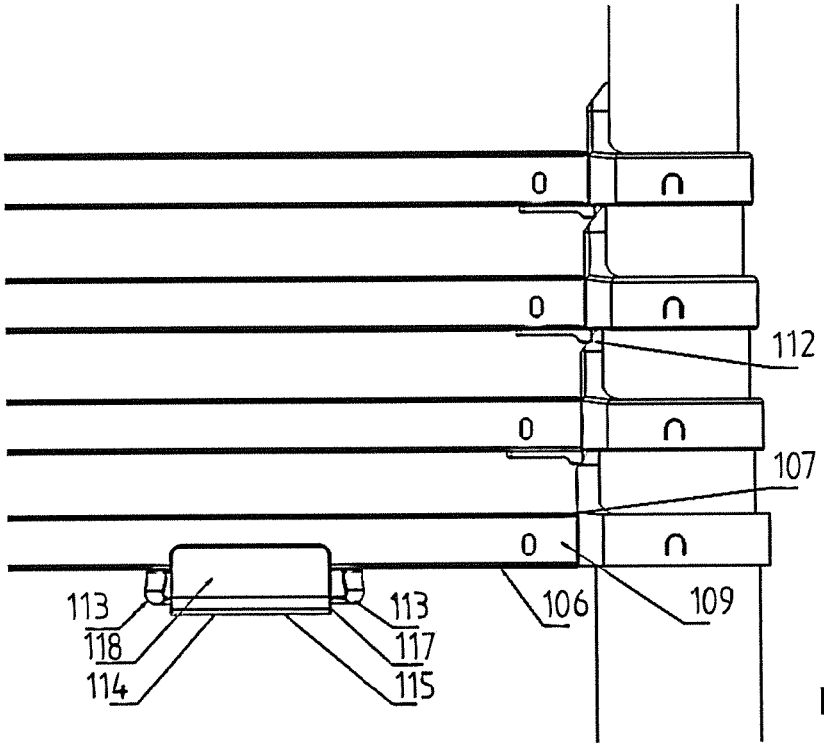
FIG. 13 shows a perspective view in close up of a top rung of a bottom ladder section of the ladder assembly of FIG. 12.
Figure 15:
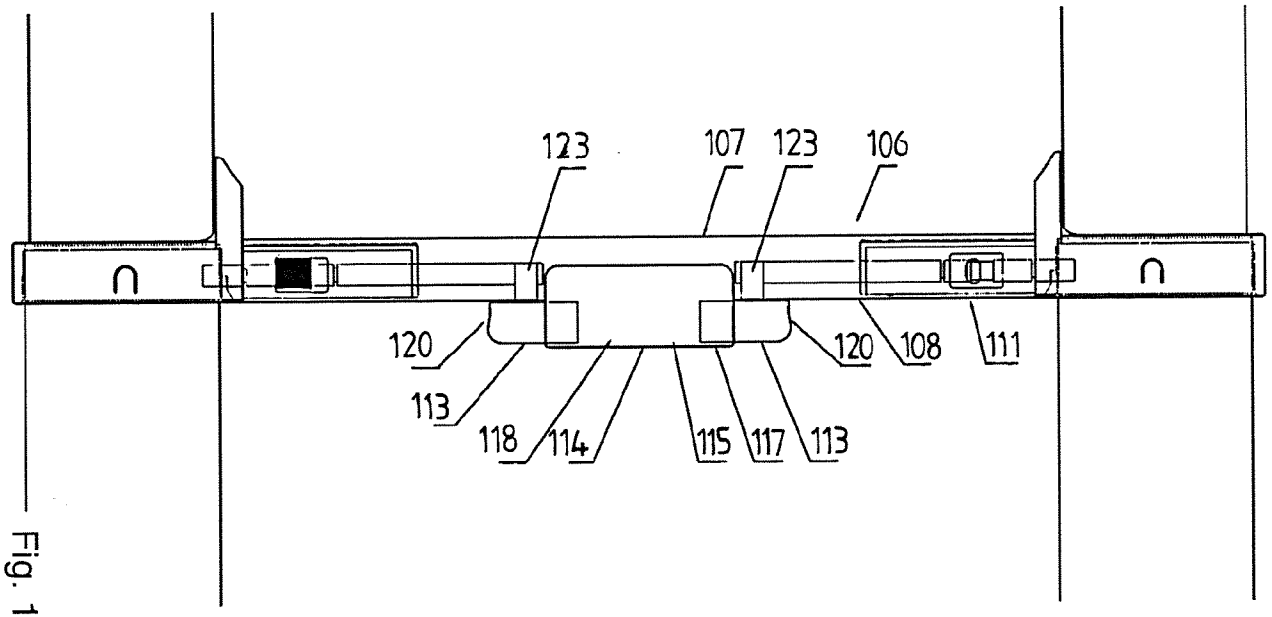
FIG. 15 shows frontal view in cross section of the top rung of FIG. 13.

In the particular embodiment shown, the grip surface 120 of the manually operable release actuators 113 is curved towards the front and the back of the grip element 114, such that, when seen in bottom view, the actuating end for pushing the actuator has a semi circular or semi oval shape.

in the embodiment shown, see FIGS. 13 and 15, the front wall and the back wall of the grip element overlap with the front wall and the back wall of the rung, such that the grip area provided by the grip element overlaps with the front and back of the rung.

Figure 16:
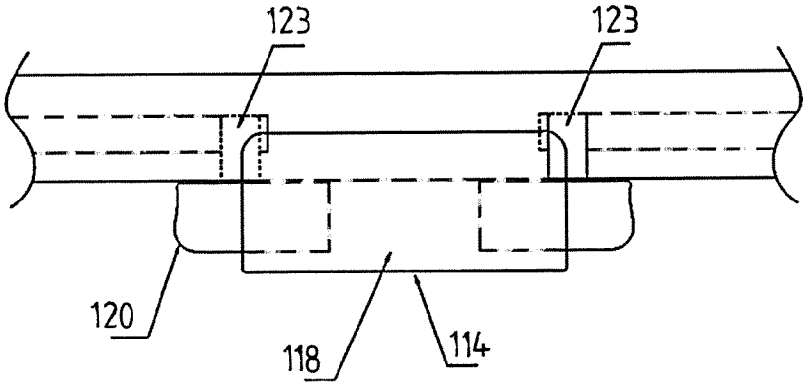
FIG. 16 shows a frontal view in cross section of the top rung of FIG. 13 with manual operable actuators in an actuated position.

In the embodiment shown, the manually operable release actuators 113 extend though slots into the interior of the rung 106,106', which slots are located in the central area of the rung. The slots and the grip element, including the manually operable release actuators are dimensioned such that the slots are covered by the grip element and the release actuators when in their actuated position, see for example FIG. 14 and FIG. 16.

In the exemplary embodiment shown, the manually operable release actuators 113 each have a an extension 123 for coupling the actuator with the linkage member, for example includes a snap provision adapted to snap around a rod-shaped linkage member.

Ladder assembly according to the second aspect of the invention, wherein the latch mechanisms and/or the actuators are provided with one or more spring elements, such as helical springs, that bias the release actuators towards their respective rest positions.

REFERENCE SIGNS

01 ladder assembly
02 top ladder section
03 bottom ladder section
04 intermediate ladder sections
05 stile member
06 ladder rung
06' top ladder rung
06" bottom ladder rung
07 connector
08 ladder rung portion connector
09 stile member portion connector
10 spacer
11 automatic latch mechanism
12 locking pin
13 manually operable release actuators
14 automatic release actuators
15 base of spacer
16 top end of spacer
17 slanted actuating surface spacer
18 top end slanted actuating surface of spacer
19 slanted support surface ladder rung
20 one side open chamber in bottom side connector
21 slanted actuating surface of automatic release actuators
22 flat section stile member
23 extension automatic release actuator
24 spring element
101 ladder assembly
102 top ladder sections
103 bottom ladder section
104 intermediate ladder sections
105 tubular stile members
106 ladder rung
106' top ladder rung bottom section
106" bottom ladder rung bottom section
107 top wall ladder rung
108 bottom wall ladder rung
109 front wall ladder rung
110 back wall ladder rung
111 latch mechanism
112 release actuator
113 manually operable release actuator
114 grip element
115 front wall grip element
116 back wall grip element
117 bottom wall grip element
118 grip surface grip element
119 linkage rod
120 grip surface manually operable release actuator
121 locking pin
122 spring element latch mechanism
123 extension

The invention claimed is:

1. A telescopically extendable and collapsible ladder assembly having at a top ladder section, a bottom ladder section, and one or more intermediate ladder sections, wherein the top ladder section and each of the one or more intermediate ladder sections have two tubular stile members arranged parallel to each other and interconnected at a top end by a ladder rung to form a U-shaped ladder section, and wherein the bottom ladder section has two tubular stile members arranged parallel to each other and interconnected by a top ladder rung and a bottom ladder rung, wherein the ladder rungs are made from an aluminium tubular profile, the profile including a top wall, a bottom wall, as well as a front and a back wall extending between the top wall and the bottom wall, wherein the stile members of the top ladder section and the one or more intermediate ladder sections are telescopically inserted into the stile members of an adjacent lower ladder section, so that the one or more intermediate ladder sections and the top ladder section can be collapsed in a collapsing direction towards the bottom ladder section, wherein the top ladder rung of the bottom ladder section and the rung of each of the one or more intermediate ladder sections arc provided at each end with an automatic latch mechanism, said automatic latch mechanisms being adapted for automatically locking the stile members of the adjacent higher ladder section in a fully extended position of said adjacent higher ladder section, wherein the automatic latch mechanisms of the intermediate ladder sections are each associated with a release actuator for unlocking the stile members of an adjacent higher ladder section in order to allow for automatic release and collapsing of the ladder assembly, wherein the automatic latch mechanisms of the bottom ladder section are each associated with a manually operable release actuator for unlocking of the stile members of the adjacent higher ladder section by a user in order to allow for a manually release and collapsing of the ladder assembly, wherein the top rung of the bottom ladder section is at its bottom side provided with a centrally arranged grip element, the grip element including a front wall, a back wall, as well as a bottom wall extending between a bottom end of the front wall and a bottom end of the back wall, wherein the bottom wall of the grip element extends substantially parallel to the bottom wall of the top rung and provides a grip surface at a distance from the bottom wall of the top rung, which grip surface allows for engaging the collapsed ladder by hand using said grip surface to carry the ladder when in a collapsed state, wherein the grip element forms a housing for the manually operable release actuators of the bottom ladder section, wherein said manually operable release actuators are adjacent the bottom wall of the rung and, via openings in lateral sides of the grip element, extend out of the grip element, and thus are accessible at lateral sides of the grip element, wherein said manually operable release actuators each have a bottom surface, and wherein the bottom surfaces of the manually operable release actuators extend from the lateral sides of the grip element and having a bottom surface being parallel and recessed from the grip surface of the bottom wall of the grip element, wherein said manually operable release actuators extend through a slot, or slots, in the bottom wall of the rung into the interior of the rung, each of said manually operable release actuators being connected to a linkage member, which extends inside the rung to the latch mechanism at the outer end of the rung, wherein said manually operable release actuators are each movable, parallel to the bottom wall of the grip element and along the bottom wall of the rung, between a rest position and an actuated position, to allow for manually operating the latch mechanisms and unlocking the stile members of the adjacent higher ladder section by pushing the manually operable release actuators towards each other and into the grip element, wherein the front wall, the back wall and the bottom wall of the grip element, define a housing volume receiving the manually operated actuators when pushed into their actuated position, wherein the manually operable release actuators are bar shaped and have a width in a direction perpendicular to the front wall and the back wall of the grip element, wherein the width of the bar shaped manually operable release actuator is substantially similar to the width of the rung to which the grip element is mounted, and wherein the slot, or slots, through which the manually operable release actuators extend into the interior of the rung are located in the central area of the rung that is covered by the grip element and the manually operable release actuators when in their actuated position.

2. The ladder assembly according to claim 1, the manually operable release actuators having a longitudinal axis extending parallel to a longitudinal axis of the top rung, the manually operable release actuators having a grip surface at an actuating end for pushing the manually operable release actuator into the grip element.

3. The ladder assembly according to claim 2, wherein the grip surface of the manually operable release actuators is curved towards the front wall and the back wall of the grip element, such that, when seen in bottom view, the actuating end for pushing the manually operable release actuator has a semi circular or semi oval shape.

4. The ladder assembly according to claim 1, wherein the front wall and the back wall of the grip element overlap with the front wall and the back wall of the rung, such that the grip surface provided by the grip element overlaps with the front and back of the rung.

5. The ladder assembly according to claim 1, wherein the grip element is an injection moulded essentially U-shaped element.

6. The ladder assembly according to claim 1, wherein the manually operable release actuators each have an extension for coupling the manually operable release actuator with the linkage member.

7. The ladder assembly according to claim 1, wherein the latch mechanisms and/or the manually operable release actuators are provided with one or more spring elements that bias the manually operable release actuators towards their respective rest positions.

8. The ladder assembly according to claim 1, wherein the grip element extends between 10 mm and 25 mm below the bottom wall of the top rung.

9. The ladder assembly according to claim 1, wherein the grip element, more in particular the grip surface provided by the grip element, has a length parallel to a longitudinal direction of the rung, which length is between 50 mm and 80 mm.

10. The ladder assembly according to claim 1, wherein the manually operable release actuators have a height between 10 mm and 25 mm.

11. The ladder assembly according to claim 1, wherein the manually operable release actuators have a width in a direction perpendicular to the front wall and the back wall of the grip element, wherein the manually operable release actuator is bar shaped and wherein the width of the bar shaped manually operable release actuator is between 15 mm and 40 mm.

12. The ladder assembly according to claim 1, wherein the manually operable release actuators, at an end facing the rung, have a grip surface for engagement by a user, and wherein the distance between those grip surfaces, when the manually operable release actuators are in their rest position, is between 90 mm and 140 mm.

13. The ladder assembly according to claim 1, wherein the manually operable release actuators, when the manually operable release actuators are each in their rest position, protrude at lateral sides of the grip element between 12 and 20 millimeters.

14. The ladder assembly according to claim 1, wherein all the latch mechanisms provided at each end of the rungs of the intermediate ladder sections are automatic latch mechanisms, of which the manually operable release actuators are arranged for cooperating with an actuator pin provided on the rung of an adjacent lower ladder section for automatically unlocking the automatic latch mechanism when the ladder section is moved in a collapsing direction towards the adjacent lower ladder section.

15. The ladder assembly according to claim 1, wherein the rung of each intermediate ladder section is provided with one or more manually operable release actuators connected to the latch mechanisms of the rung to allow for manual unlocking of the stile members of an adjacent higher ladder section by a user in order to allow for a section-by-section manually release and collapsing of the ladder assembly.

16. The ladder assembly according to claim 1, wherein the latch mechanisms and the manually operable release actuators are provided with one or more spring elements that bias the manually operable release actuators towards their respective rest positions.

17. A loft ladder including a ladder assembly according to claim 1.

18. A stepladder having a first stepladder assembly and a second stepladders assembly hinged to one another so as to be in a storage position folded against one another and an operative position similar to an inverted V at least one of the stepladder assemblies being a ladder assembly according to claim 1.

19. A work platform including a ladder assembly according to claim 1.

* * * * *